US008091496B2

(12) United States Patent
Cook et al.

(10) Patent No.: US 8,091,496 B2
(45) Date of Patent: Jan. 10, 2012

(54) MAST TRACK WITH EXTERNAL HEADBOARD CAR

(75) Inventors: Fred C. Cook, Assonet, MA (US); William H. Donaldson, Middletown, RI (US)

(73) Assignee: Schaefer Marine, Inc., New Bedford, MA (US)

( * ) Notice: Subject to any disclaimer, the term of this patent is extended or adjusted under 35 U.S.C. 154(b) by 252 days.

(21) Appl. No.: 12/437,076

(22) Filed: May 7, 2009

(65) Prior Publication Data

US 2010/0282151 A1 Nov. 11, 2010

(51) Int. Cl.
*B63H 9/04* (2006.01)

(52) U.S. Cl. ..... 114/108; 114/112; 114/204

(58) Field of Classification Search ..... 114/107, 114/108, 112, 204
See application file for complete search history.

(56) References Cited

U.S. PATENT DOCUMENTS

| | | | | |
|---|---|---|---|---|
| 3,058,138 | A | 10/1962 | Tomlinson | |
| 3,331,348 | A | 7/1967 | Dyer | |
| 4,228,755 | A | 10/1980 | Graham | |
| 4,236,475 | A | 12/1980 | Merry | |
| 4,597,347 | A | 7/1986 | Spanopoulos | |
| 4,821,664 | A | 4/1989 | Dahmen | |
| 5,127,351 | A | 7/1992 | Breems | |
| 5,305,700 | A | 4/1994 | Strong et al. | |
| 5,540,171 | A * | 7/1996 | Monahan | 114/204 |
| 5,546,881 | A | 8/1996 | Frederiksen | |
| 5,697,314 | A | 12/1997 | Clausin | |
| 6,145,460 | A | 11/2000 | Brookes | |
| 6,371,037 | B1 | 4/2002 | Cook et al. | |
| 6,575,108 | B1 | 6/2003 | Lindström | |
| 8,001,916 | B2 | 8/2011 | Cook et al. | |

OTHER PUBLICATIONS

Hasse, C., "A Mainsail For All Seasons," *Cruising World*, pp. 1-3, [online]. Sep. 2, 2002, [retrieved on Mar. 18, 2009]. Retrieved from the Internet URL:http://www.cruisingworld.com/article_print.jsp?ID=201148.

Hasse, C., "Cruising Sales: Mainsails," *Cruising Mainsails*, pp. 1-9, [online]. Apr. 30, 2004, [retrieved on Mar. 18, 2009]. Retrieved from the Internet URL:http://www.porttownsendsails.com/articles.htm-.

* cited by examiner

*Primary Examiner* — Stephen Avila
(74) *Attorney, Agent, or Firm* — Hamilton, Brook, Smith & Reynolds, P.C.

(57) ABSTRACT

Disclosed are luff extrusions that solve problems of batten chafing and friction locking. The inventive luff extrusions provide batten end receptacles with channels for headboard cars. The luff extrusions absorb the wind-generated compressive forces exerted by the battens on the batten pockets and eliminate the need for sail slides.

10 Claims, 6 Drawing Sheets

MAST TRACK WITH EXTERNAL HEADBOARD CAR

RELATED APPLICATIONS

This application is related to Ser. No. 12/437,086, "Mega Yacht Mast Tracking System with Articulating Sail Feeder," and Ser. No. 12/437,062, "Sectionalized Mast Track," both of which are being filed on the same day as the instant application. The subject matter of this application is also related to U.S. Pat. No. 6,371,037, "Sail Furling System," to Cook et al. filed on Dec. 26, 2000.

The above-referenced applications and patent are incorporated herein by reference in their entireties.

BACKGROUND

Yachts with fully battened mainsails typically use battens of relatively rigid material, such as fiberglass, wood, and the like, positioned in batten pockets sewn in the mainsail. The battens and batten pockets extend horizontally from the trailing edge, or leech, to the forward edge, or luff, of the mainsail. The battens allow the sail to retain its shape in a variety of wind conditions and to flake more quickly and easily when lowered on a boom. More importantly, the battens support roach, the sail area that lies outside a straight line drawn from the head, the corner of the sail closest to the top of the mast, to the clew, the corner of the sail closest to the aft end of the boom. Roach enhances sailing performance by increasing the area of the sail and by changing the shape of the sail. Battens also prolong the life of the sail by reducing flogging in high wind or head to wind conditions.

Unfortunately, the wind captured by the sail to propel the yacht also pushes the battens against the forward edges of their respective batten pockets, causing the battens to poke through the luff end of the sail. Once the battens work through the batten pockets, the sail must be repaired or replaced. The battens also twist and compress the sail slides that keep the sail in the mast track, creating friction that impedes raising and lowering the sail. This friction can be great enough to lock the sail in the mast track and/or break the sail slides. Moreover, the forward end of the battens can move laterally past the sail slides and inwardly toward the mast, and can hit the mast and/or jam the bolt rope.

A variety of fittings for full batten mainsails have been proposed, including those disclosed in U.S. Pat. Nos. 5,127,351 to Breems; 4,823,720 to Foster; 3,092,064 to Benedict; 591,446 to Worthen; and 259,209 to Rand. Typically, these batten end fittings have joints that couple the batten to the sail slide to eliminate friction between the sail slides and the mast track caused by twisting and compression of the battens. Such joints usually do not permit the battens to rotate freely in every dimension, nor do they completely eliminate friction between the slides and the mast due to torque and compression. Joints that permit three-dimensional rotation generally require complex, rigid mechanical connectors that must be mounted on specialized slides integral with the connectors themselves. Unfortunately, these prior-art batten end fittings cannot withstand the high forces exerted by fully compressed or torqued battens of the larger sails used on larger yachts.

SUMMARY OF THE INVENTION

Embodiments of the present invention include luff extrusions and methods for attaching a sail luff comprising one or more battens to a mast of a yacht. Example luff extrusions include a batten guide formed of two substantially parallel batten guide arms. A luff passage connects the batten guide to a luff rope slot formed forward of the batten guide. Example luff extrusions also include a channel configured to guide a headboard car along an axis substantially parallel to the long axis of the mast.

In certain embodiments, the channel is formed on the exterior of the luff extrusion body for use with an external headboard car. For example, the channel may be formed of indentations substantially abeam of the luff rope slot on the exterior of the luff extrusion body. Alternatively, the channel may be formed of extrusions forward of the luff rope slot on the exterior of the luff extrusion body.

In other embodiments, the channel may be formed between the batten guide arms for use with an internal headboard car. Luff extrusions for use with internal headboard cars may also include hooks or catches at the ends of the batten guide arms to retain the headboard car in the batten guide. Channels formed between the batten guide arms may be configured to guide round or disc-shaped headboard cars.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
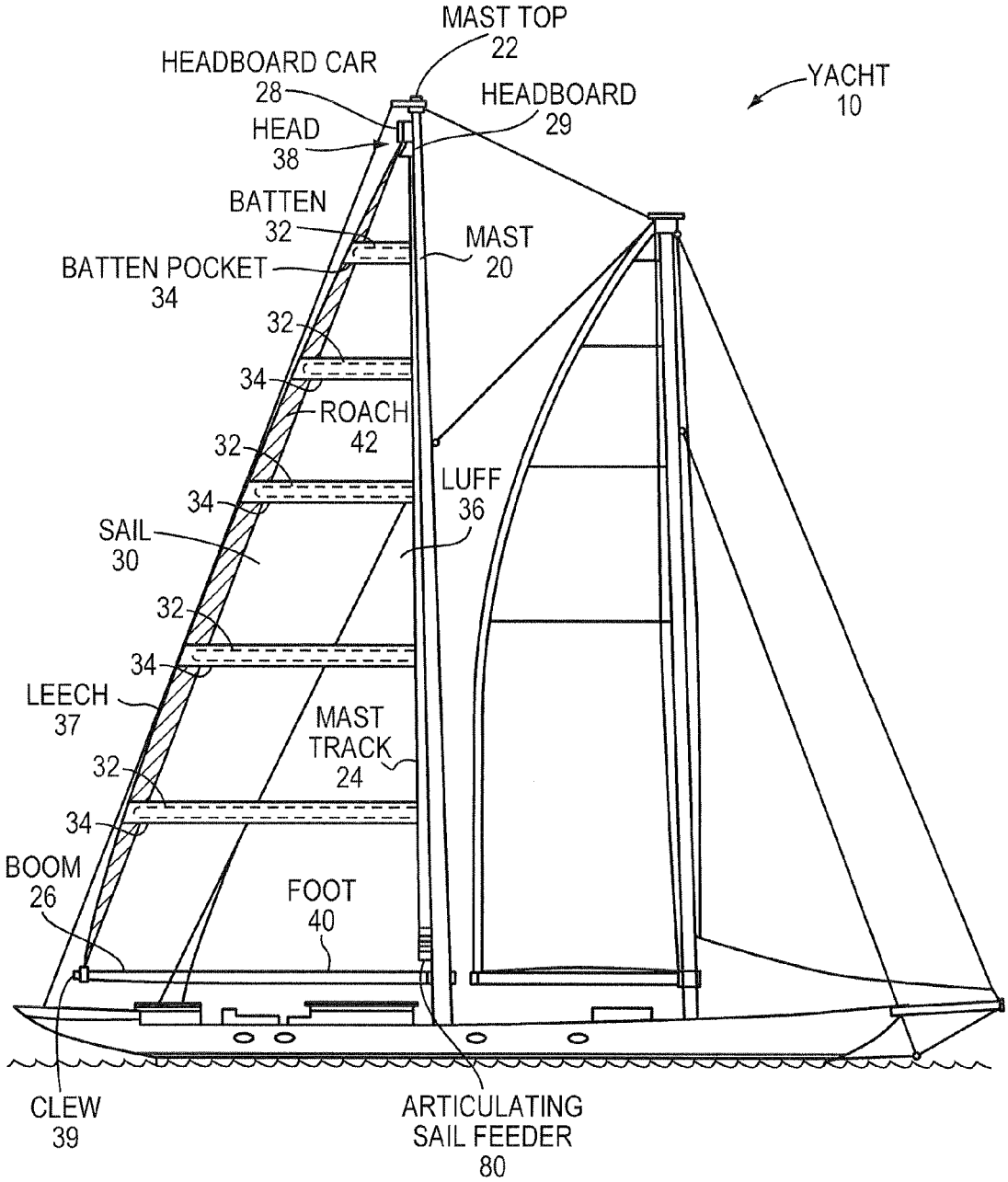
FIG. 1 is an elevation view of a yacht.

FIG. 1 shows a yacht 10 with a mast 20 and a boom 26. The boom 26 stores a sail 30, which may be raised with a halyard (not shown) to capture wind and propel the yacht 10. A headboard 29 reinforces the head 38 of the sail 30 to prevent high loads from tearing apart the head 38. A headboard car 28 coupled to the headboard 29 and the halyard travels smoothly along a mast track 24 fixed to the mast 20, facilitating raising and lowering of the sail 30. The mast track 24 guides the headboard car 28 and a luff rope (not shown; also known as a sail bolt rope or bolt rope) stitched into the forward edge, or luff 36, of the sail 30 along an axis parallel to the long axis of the mast 20. Although the headboard car 28 shown in FIG. 1 travels on the outside of the mast track 24, alternative headboard cars may be configured to travel within a groove internal to the mast track 24.

The sail 30 shown in FIG. 1 is a fully battened mainsail 30 with battens 32 that run generally parallel to the bottom edge, or foot 40, of the sail 30 from the luff 36 (leading edge) to the trailing edge, or leech 37, of the sail 30. The battens 32 are stitched into batten pockets 34 in the sail 30. Standard battens (not shown) run only partway from the luff 36 to the leech 37, trading long-term performance for reduced chafing and easier handling. Battens may be oriented in other directions or combinations of directions; for example, alternative battens may run perpendicularly from the leech 37 to intersect the foot 40 and the luff 36 at substantially complementary angles.

Full battens 32 support roach 42, the sail area that lies outside a straight line from the head 38 to the lower aft corner, or clew 39, of the sail 30. Typically, the supporting battens 32 are about three times longer than the roach 42 that they support. Roach 42 enhances sail performance by adding 15-30% more sail area to a triangular sail, such as the sail 30 shown in FIG. 1. More importantly, mainsails with roach 42 have elliptically shaped heads and planforms that improve performance on all points of sail, particularly to weather.

Unfortunately, full-length battens 32 reduce the life of the sail 30 by chafing against the batten pockets 34. The same forces that pull the sail taut to propel the yacht 10 push the battens 32 towards the mast 20, causing the battens 32 to chafe against the batten pockets 34. Eventually, this chafing causes the battens 32 to tear or poke through the forward ends of the batten pockets 34. Reinforcing the batten pockets 34 alleviates this problem on vessels with smaller sails 30, but reinforcement is not sufficient to withstand chafing due to the larger compressive forces exerted on battens 32 in larger sails. In addition, compression increases friction on the sail slides that run in mast tracks 24 without headboard cars 28, making it difficult to raise, lower, or reef the sail 30.

Figure 2A:
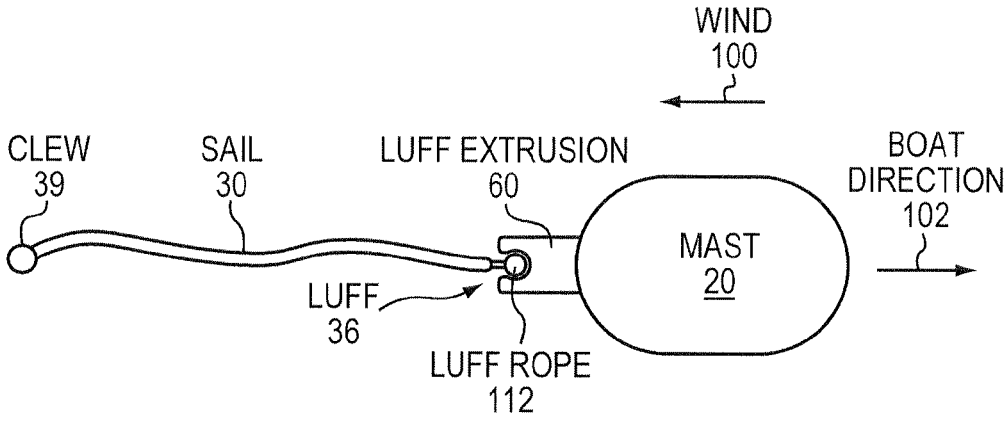
FIGS. 2A-2C are plan views of a fully battened sail on a yacht in different wind conditions.
Figure 2B:
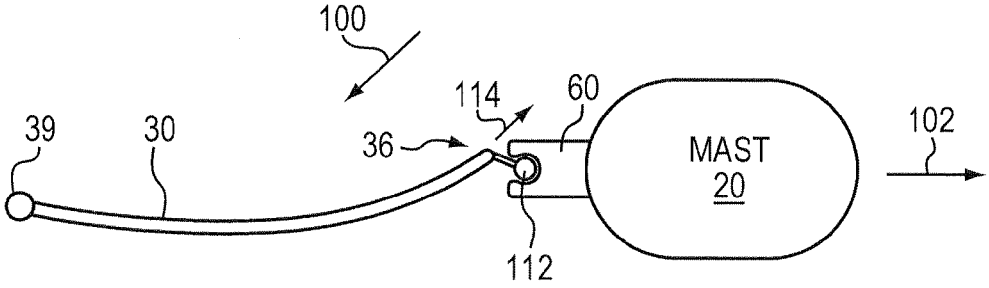
Figure 2C:
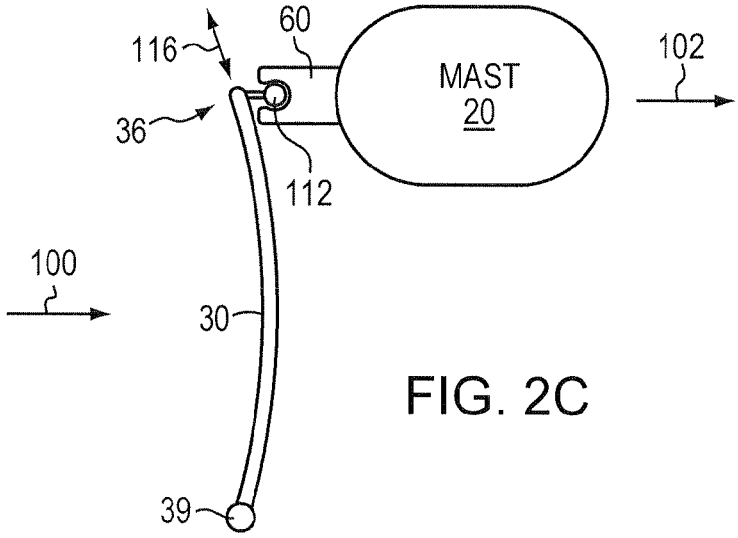

FIGS. 2A-2C are plan views of a fully battened sail 30 of a yacht traveling in a direction 102 in various wind conditions. The sail 30 is attached to the mast 20 with a luff rope 112 that slides in a slot in a luff extrusion 60 attached to the mast 20. Sail slides (not shown) in the slot permit the sail to be raised or lowered. Wind 100 exerts compressive and/or torquing loads on the sail 30 and the battens (not shown) stitched into the sail 30.

In FIG. 2A, the yacht 10 is facing directly into the wind 100, so the wind 100 does not exert any force on the sail 30, which, therefore, remains limp and does not exert any force on the luff 36, A yacht 10 facing directly into the wind is said to be "in irons" or "heaved to." The yacht 10 does not advance under this point of sail, but lies motionless in the water, except for the effects of the tide or wind 100 on the hull.

FIG. 2B shows wind 100 blowing at an acute angle with respect to the direction of travel 102. In this case, the boat is said to be "close-hauled." The clew 39 of the sail 30 is attached to the after end of the boom (not shown), so the sail 30 bellies out slightly due to pressure exerted by the wind 100. As the sail 30 pulls taut due to the wind pressure, it exerts a compressive force in a direction 114 on the luff 36, driving the luff 36 forward and out of line with the opening in the luff extrusion 60. This compressive force also causes the battens in the sail 30 to chafe against the forward edges of their respective batten pockets; eventually, the battens wear through the batten pockets, ruining the sail 30. Compressive forces also strain the junction between the luff 36 and the tuff rope 112 and increase friction between the sail slides and the slot in the tuff extrusion 60.

FIG. 2C shows wind 100 blowing from dead aft, i.e., exactly along the direction of travel 102. The wind 100 causes the sail 100 to belly even more, compressing the tuff 36 as in FIG. 2B. In this case, however, compression produces a force vector 116 that is almost perpendicular to the direction of travel 102, resulting in more severe chafing on the sail 30. Compression strain at the junctions between the luff 36 and the tuff rope 112 is also more severe in the situation shown in FIG. 2C than that illustrated in FIG. 2B. Friction between the sail slides and the slot in the luff extrusion 60 may be great enough to lock the sail slides in place, preventing the sail 30 from being raised or lowered.

Figure 3:
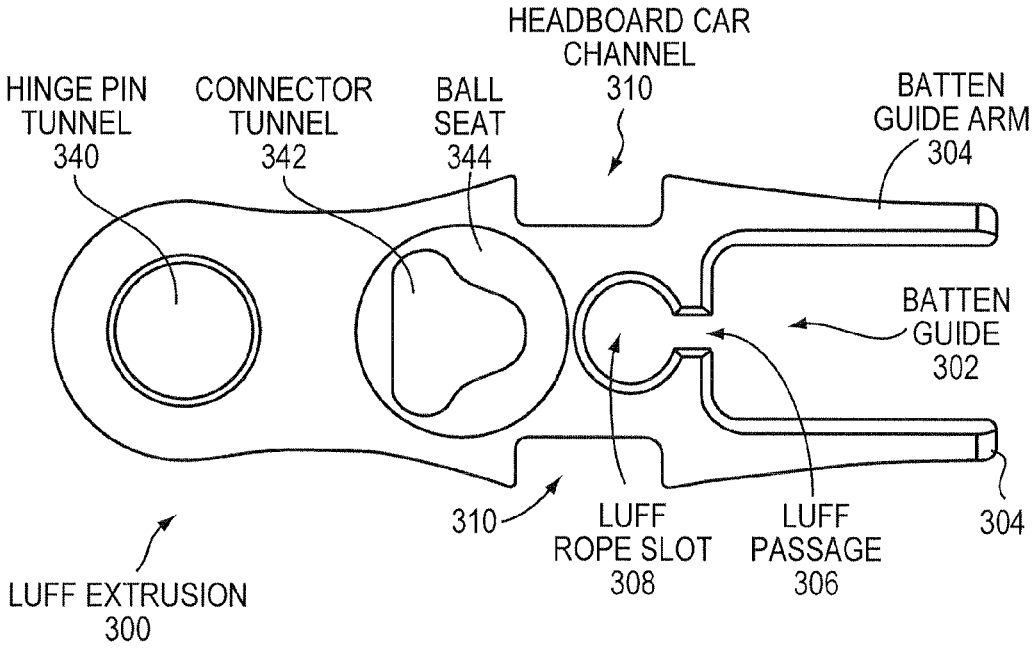
FIG. 3 is a plan view of a luff extrusion suitable for use with an external headboard car according to embodiments of the present invention.

FIG. 3 is a plan view of a batten receptacle, or luff extrusion 300, suitable for use with an external headboard car 28. The luff extrusion 300 solves the problem of batten poke or chafing by providing a batten guide 302 that receives battens along the length of the mast 20, such as the full battens 32 shown in FIG. 1. Unlike the batten receptacles disclosed in U.S. Pat. No. 6,371,037 to Cook et al, the present inventive luff extrusion 300 also eliminates problems associated with friction-locked sail slides by providing a channel 310 for a headboard car 28 (FIG. 1) that disposes with the need for sail slides.

The luff extrusion 300 includes a pair of substantially parallel batten guide arms 304 that form the batten guide 302. A luff passage 306 connects the batten guide 302 to a luff rope slot 308 configured to hold a luff rope sewn into the luff 36 of a sail 30. As wind fills the sail 30, compressing the battens 32 (FIG. 1), the battens 32 push against the forward edge of the batten guide 302, reducing chafing on the batten pockets 34 (FIG. 1). The batten guide arms 304 also stabilize battens 32 subject to rotational forces, such as those shown in FIG. 2C.

As shown in FIG. 3, the headboard car channel 310 is formed substantially next to (i.e., abeam of) the luff rope slot 308, defining a travel axis for the headboard car 28 (FIG. 1) that is substantially coincident with the axis formed by the luff rope slot 308. Because the headboard car 28 and the luff rope (not shown) travel along the same axis, torque on the headboard car 28 or the headboard 29 (FIG. 1) in the plane of the sail 30 is less likely to cause the headboard car 28 to shift, jam, or stick in the headboard car channel 310. As a result, the luff rope and headboard car 28 travels freely up and down an axis parallel to the longitudinal axis of the mast 20.

The tuff extrusion 300 may also include a hinge pin tunnel 340, a connector tunnel 342, and a feeder ball seat 344. The hinge pin tunnel 340 can be used to hold a hinge pin that connects a mast track 24 with the inventive tuff extrusion cross section 300 to a hinge on the mast 20. The hinge and hinge pin allow the mast track 24 to pivot about the longitudinal axis of the mast 20. Similarly, the connector tunnel 342 can be used to connect sections of a sectionalized mast track to each other so that all the sections pivot on one centerline, as described in Ser. No. 12/437,062, "Sectionalized Mast Track," incorporated herein by reference in its entirety.

In a preferred embodiment, the luff extrusion 300 is 141 mm long and varies in width from about 46 mm just forward of the headboard car channel 28 to about 32 mm at the channel 28 itself. The headboard car channels 310 are each about 22 mm wide and about 7 mm deep. The batten arms 304 are about 43 mm long, forming a batten guide 302 with a length of 43 mm and a width of about 26 mm. The luff passage 306 may be about 5 mm wide and about 6 mm long; the luff rope slot 308 can be about 7.5 mm in radius. Edges of mast tracks 24 with the present inventive luff extrusion cross section 300 may be beveled, chamfered, and/or radiused as appropriate.

Mast tracks 24 with the inventive luff extrusion cross section 300 may be fabricated of 6005 aluminum alloy or any other suitable material. Generally, suitable materials are at least moderately strong; capable of bending, flexing and twisting; suitable for machining, welding, and brazing; and corrosion resistant (or able to be treated or coated with corrosion-resistant material). Mast tracks with the inventive luff extrusion cross section may be made by machining, extrusion, or any other suitable manufacturing techniques.

Figure 4A:
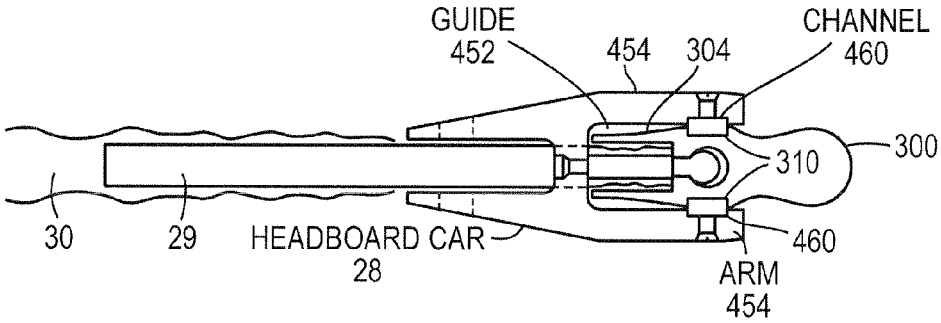
FIGS. 4A and 4B are plan and elevation views, respectively, of an external headboard car, headboard, and mast track with an example inventive luff extrusion cross section.
Figure 4B:
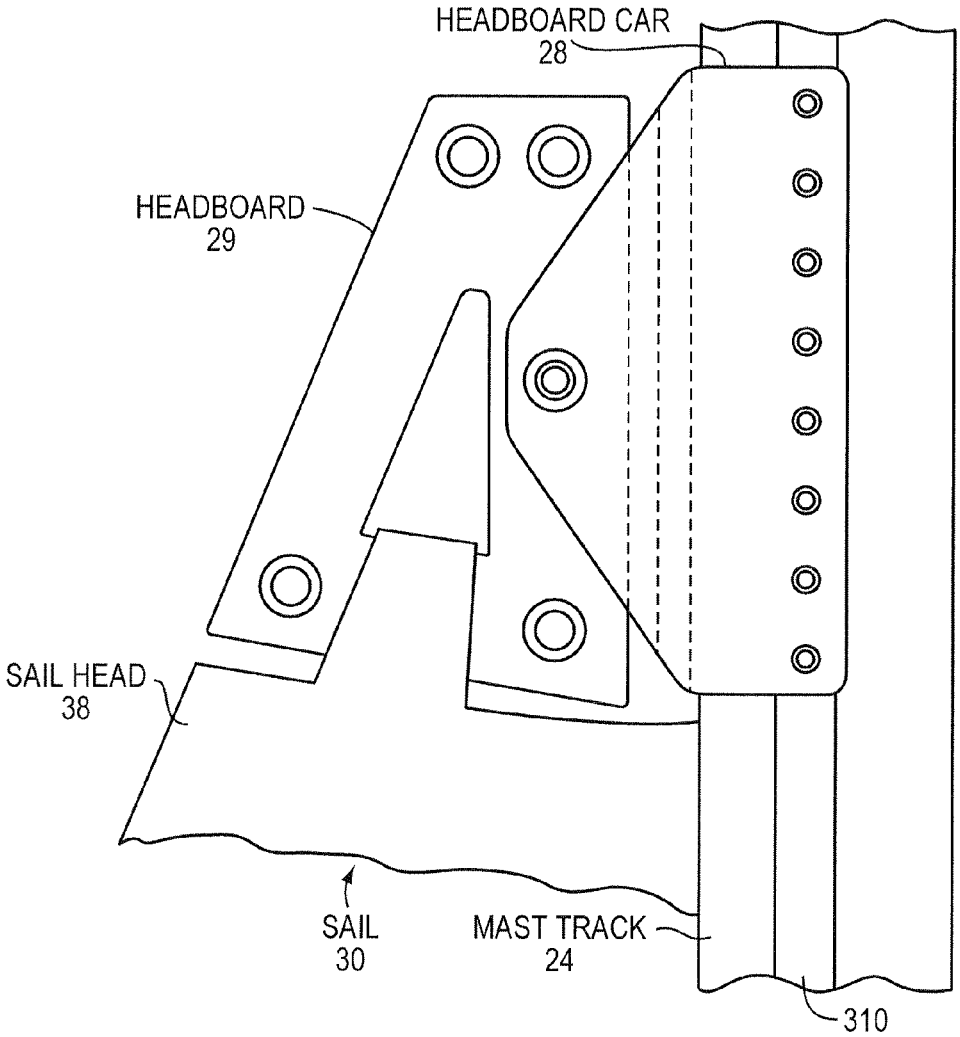

FIG. 4 shows perspective and plan views of a sail 30, headboard car 28, and mast track 24 with the present inventive luff extrusion cross section 300. The headboard car 28, which is coupled to the head 38 of a sail via a headboard 29, includes a guide 452 formed of two substantially parallel arms 454 that fit around the outside of the luff extrusion 300. The arms 454 on the headboard car 28 have channels 460 that mate with the complementary channels 310 on the luff extrusion 300. Bearings (not shown) between the channels 310 on the luff extrusion 300 and the channels 460 on the headboard car 28 allow the headboard car 28 to travel freely along an axis substantially parallel to the mast 20 (FIG. 1).

Because the headboard car 28 travels smoothly along the bearings between the channels 460 and 310, the sail 30 can be raised and lowered with a halyard (not shown) attached to the headboard car 28. In contrast to conventional sails, which are raised with halyards attached directly to the head 38 or the headboard 29, sails 30 coupled to headboard cars 28 do not need sail slides to ensure smooth travel of the sail up and down the mast. As a result, sails raised with headboard cars 28 configured with luff extrusions 300 of the present invention do not suffer from the compression- and torque-induced friction that locks sail slides into place.

In a preferred embodiment, the headboard car is made of aluminum or any other suitably strong, light, and corrosion-resistant material. The guide 452 is wide enough and long enough to accommodate the luff extrusion 300. For example, the arms 454 may be about 120 mm long and spaced at least 46 mm apart. The edges of the headboard car 28 may be beveled, chamfered, and/or radiused as appropriate.

Figure 5A:
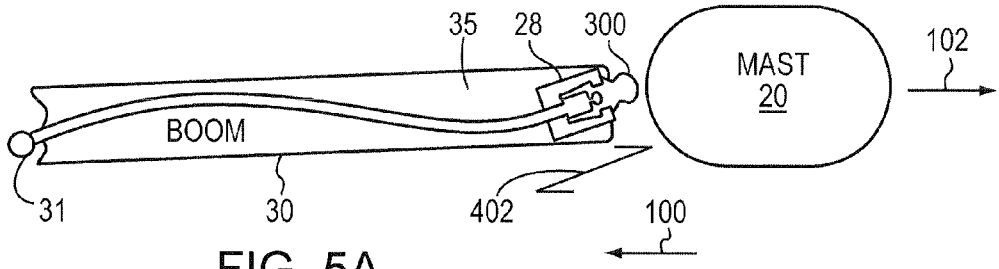
FIGS. 5A-5C are plan views of a fully battened sail coupled to an example inventive luff extrusion on a yacht in the same wind conditions shown in FIGS. 2A-2C.
Figure 5B:
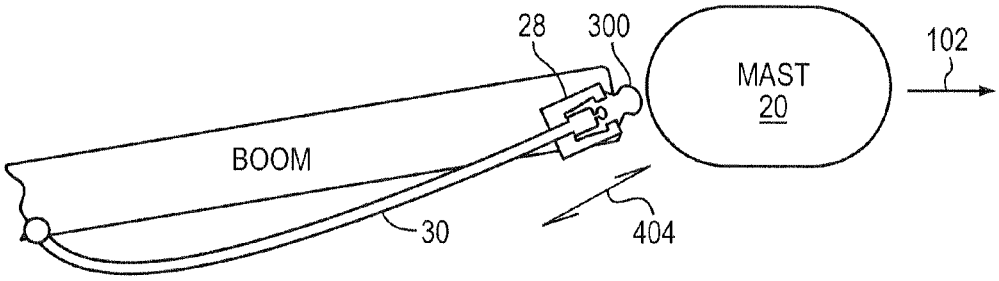
Figure 5C:
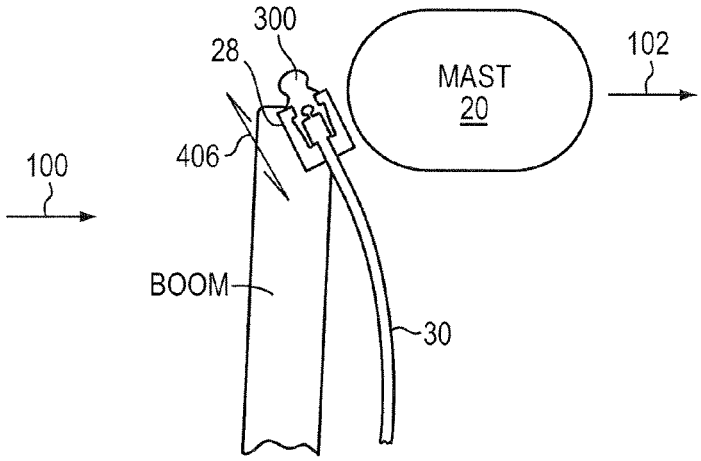

FIGS. 5A-5C are plan views of a fully battened sail coupled to a luff extrusion 300 and headboard car 28 on the mast 20 of a yacht 10 in the same wind conditions as those depicted in FIGS. 2A-2C. In FIG. 5A, the wind 100 is blowing directly opposite the direction of travel 102, so the battens in the sail 30 do not exert any pressure on the luff extrusion 300. As the wind 100 shifts direction so that the boat is sailing close hauled in FIG. 5B, the wind 100 causes the sail 30 to pull taut, pushing the battens 32 towards the mast 20. This compression pushes the battens along a vector 404 into the luff extrusion 300, which withstands the compression that would otherwise cause chafing and wear along the sail luff 36. When the wind 100 blows from the stern, as shown in FIG. 5C, the luff extrusion 300 absorbs both compressive forces along vector 406 and rotational forces that cause the sail 30 and battens 32 to twist against the arms 304 of the luff extrusion 300.

Figure 6:
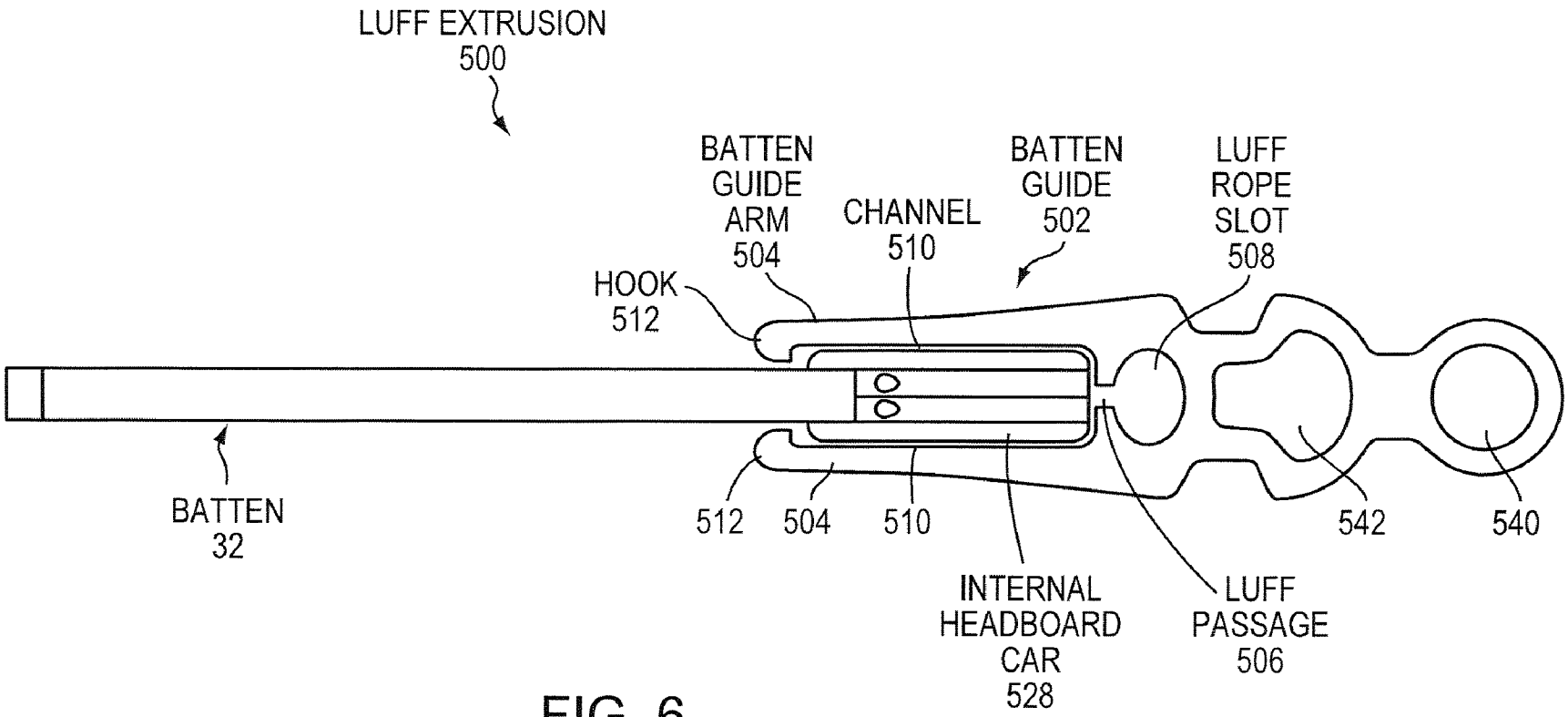
FIG. 6 is a plan view of a luff extrusion suitable for use with an internal headboard car according to alternative embodiments of the present invention.

FIG. 6 is a plan view of an alternative luff extrusion 500 with an internal headboard car 528. The luff extrusion 500 includes a pair of substantially parallel batten guide arms 504 that form a batten guide 502, which connects to a luff rope slot 508 via a luff passage 506. Each batten guide arm 504 terminates in a hook shape 512 or similar configuration that defines a headboard car channel 510 inside the batten guide 502. The internal headboard car 528, which may be round or disc-shaped (i.e., shaped like a hockey puck), travels in the space defined by the batten guide 502 along an axis defined by the headboard car channel 510. The hooks 512 retain the headboard car 528 within the batten guide 502.

The batten guide 502 receives battens 32 sewn in the sail below the headboard car 528. As compressive forces push the battens 32 forward, the battens 32 push against the batten guide 502, rather than chafing against the forward edges of their respective batten pockets 34. Similarly, the batten guide arms 504 hold the battens 32 as the battens 32 twist and rotate, reducing friction between the battens 32 and the respective batten pockets 34.

The alternative cross section 500 also includes a connector tunnel 542 and a hinge pin tunnel 540, which are configured to retain a tensioning line 86 and limiting pins 90, respectively, as described in Ser. No. 12/437,086, "Mega Yacht Mast Tracking System with Articulating Sail Feeder." The connector 542 may also be configured to receive ball joints 94 with a ball joint seat (not shown).

Of course, other configurations of headboard car channels 310 are possible. For example, the headboard car 28 could ride on channels formed by everted channels, protrusions, or rails that stick out from a mast track 24 with the inventive luff extrusion cross section. The channels may include more than two channels on each side, or may be formed further forward or aft along the inventive luff extrusion. The channels may be integral to the luff extrusion 300 or may formed by additional fixing parts to the mast 20 or mast track 28.

While this invention has been particularly shown and described with references to example embodiments thereof, it will be understood by those skilled in the art that various changes in form and details may be made therein without departing from the scope of the invention encompassed by the appended claims.

For example, the generic term yacht as used herein includes sailing vessels, boats, and ships of various sizes, including mega-yachts, which may be 40 feet or longer. Similarly, the generic term sail includes mainsails, which are used primarily to propel yachts. Likewise, the generic term mast includes mainmasts and other masts. In addition, the terms luff rope, sail bolt rope, and bolt rope may be used interchangeably.

Further, the various dimensions, materials, and surface or edge processing are for purposes of non-limiting illustration. Other dimensions, materials, and manufacturing processing are suitable.

What is claimed is:

1. A luff extrusion for attaching a sail luff comprising one or more battens to a mast of a yacht, the luff extrusion comprising:

a batten guide formed of two substantially parallel batten guide arms;

a luff extrusion body into which a luff rope slot is formed forward of the batten guide;

a luff passage connecting the batten guide and the luff rope slot; and a channel formed of indentations substantially abeam of the luff rope slot on the exterior of the luff extrusion body, the channel configured to guide a headboard car along an axis substantially parallel to the axis of the mast, wherein the channel guiding the headboard car obviates need for sail slides.

2. A method of attaching a sail luff comprising one or more battens to a mast of a yacht, the method comprising:

employing a luff extrusion on a mast, the luff extrusion comprising:

a batten guide formed of two substantially parallel batten guide arms;

a luff extrusion body into which a luff rope slot is formed forward of the batten guide;

a luff passage connecting the batten guide and the luff rope slot; and a channel formed of indentations substantially abeam of the luff rope slot on the exterior of the luff extrusion body, the channel configured to guide a headboard car along an axis substantially parallel to the axis of the mast, wherein the channel guiding the headboard car obviates need for sail slides.

3. A luff extrusion for attaching a sail luff comprising one or more battens to a mast of a yacht, the luff extrusion comprising:

a batten guide formed of two substantially parallel batten guide arms;

a luff extrusion body into which a luff rope slot is formed forward of the batten guide;

a luff passage connecting the batten guide and the luff rope slot; and a channel formed of extrusions forward of the luff rope slot and on the exterior of the luff extrusion body, the channel being configured to guide a headboard car along an axis substantially parallel to an axis of the mast.

4. A luff extrusion for attaching a sail luff comprising one or more battens to a mast of a yacht, the luff extrusion comprising:

a batten guide formed of two substantially parallel batten guide arms, the batten guide arms including hooks configured to retain a headboard car in the batten guide;

a luff extrusion body into which a luff rope slot is formed forward of the batten guide;

a luff passage connecting the batten guide and the luff rope slot; and a channel formed between the batten guide arms and configured to guide the headboard car along an axis substantially parallel to an axis of the mast.

5. The luff extrusion as claimed in claim 4 wherein the batten guide arms include hooks configured to retain the headboard car in the batten guide.

6. The luff extrusion as claimed in claim 4, wherein the channel is configured to guide a disc-shaped headboard car.

7. A method of attaching a sail luff comprising one or more battens to a mast of a yacht, the method comprising:

employing a luff extrusion on a mast, the luff extrusion comprising:

a batten guide formed of two substantially parallel batten guide arms;

a luff extrusion body into which a luff rope slot is formed forward of the batten guide;

a luff passage connecting the batten guide and the luff rope slot; and a channel formed of extrusions forward of the luff rope slot and on the exterior of the luff extrusion body, the channel being configured to guide a headboard car along an axis substantially parallel to an axis of the mast.

8. A method of attaching a sail luff comprising one or more battens to a mast of a yacht, the method comprising:

employing a luff extrusion on a mast, the luff extrusion comprising:

a batten guide formed of two substantially parallel batten guide arms;

a luff extrusion body into which a luff rope slot is formed forward of the batten guide;

a luff passage connecting the batten guide and the luff rope slot; and a channel formed between the batten guide arms and configured to guide a headboard car along an axis substantially parallel to an axis of the mast.

9. The method as claimed in claim 8, wherein the batten guide arms include hooks configured to retain the headboard car in the batten guide.

10. The method as claimed in claim 9, wherein the channel is configured to guide a disc-shaped headboard car.

* * * * *